US010273726B2

(12) United States Patent
Park

(10) Patent No.: US 10,273,726 B2
(45) Date of Patent: Apr. 30, 2019

(54) DUAL UNLOCKING HOOD LATCH SYSTEM

(71) Applicant: Hyeon Tae Park, Yeongchun (KR)

(72) Inventor: Hyeon Tae Park, Yeongchun (KR)

(73) Assignee: Pyeong Hwa Automotive Co., Ltd, Deagu (KR)

( * ) Notice: Subject to any disclaimer, the term of this patent is extended or adjusted under 35 U.S.C. 154(b) by 212 days.

(21) Appl. No.: 14/481,537

(22) Filed: Sep. 9, 2014

(65) Prior Publication Data

US 2015/0345186 A1 Dec. 3, 2015

(30) Foreign Application Priority Data

May 30, 2014 (KR) ..... 10-2014-0066303

(51) Int. Cl.

| | |
|---|---|
| ***E05B 83/24*** | (2014.01) |
| ***E05B 85/26*** | (2014.01) |
| ***E05C 3/02*** | (2006.01) |
| *E05C 3/06* | (2006.01) |
| *E05C 3/16* | (2006.01) |

(52) U.S. Cl.

CPC ..... *E05B 83/24* (2013.01); *E05B 85/26* (2013.01); *E05B 83/243* (2013.01); *Y10T 292/108* (2015.04); *Y10T 292/1043* (2015.04); *Y10T 292/1047* (2015.04); *Y10T 292/1048* (2015.04); *Y10T 292/1075* (2015.04); *Y10T 292/1078* (2015.04); *Y10T 292/1082* (2015.04)

(58) Field of Classification Search

CPC ..... E05B 83/24; E05B 85/26; E05B 83/243; E05B 83/247; E05B 85/20; E05B 2015/042; E05B 79/08; Y10T 292/1039; Y10T 292/1064; Y10T 292/1075; Y10T 292/1043; Y10T 292/108–292/1082; Y10T 292/1047–292/1048; Y10T 292/1078; B60N 2/938; B60N 2/01583; B60N 2/366; B60N 2/01516

USPC ..... 292/200, 201, 216, DIG. 23, 217, 198, 292/DIG. 14

See application file for complete search history.

(56) References Cited

U.S. PATENT DOCUMENTS

| | | | | |
|---|---|---|---|---|
| 2,877,038 A * | 3/1959 | Kramer | ..... | E05B 83/16 292/216 |
| 2,924,473 A * | 2/1960 | Krause | ..... | E05B 83/16 292/11 |
| 3,572,793 A * | 3/1971 | Cole | ..... | E05B 83/16 292/216 |

(Continued)

*Primary Examiner* — Kristina R Fulton
*Assistant Examiner* — Faria F Ahmad
(74) *Attorney, Agent, or Firm* — Sul Lee

(57) ABSTRACT

A dual unlocking hood latch system allows a user to open a hood of the automobile vehicle while staying in the vehicle. The dual unlocking hood latch system includes a base fixed to a main body. The base includes a moving groove portion to guide the movement of a striker. A latch gear, which includes a plurality of locking portions, is pivotably attached to a front side of the base to retain the striker when the striker is entered through the moving groove portion to a locking position. A pawl, pivotably attached to the base, controls the movement of the latch gear by transmitting rotational motion when in contact. And a stopper portion, pivotably attached to the base, is elastically biased to move toward the pawl such that the stopper portion is pushed by the pawl to restrain pivoting movement of the latch gear.

8 Claims, 11 Drawing Sheets

(56) References Cited

U.S. PATENT DOCUMENTS 3,905,624 A * 9/1975 Fujita ..... E05B 83/16 292/11
4,045,064 A * 8/1977 Okada ..... E05B 83/16 292/125
4,478,441 A * 10/1984 Fiordellisi ..... E05B 83/16 292/216
4,875,724 A * 10/1989 Gruber ..... E05B 83/16 292/216
4,896,907 A * 1/1990 Hayakawa ..... E05B 77/04 292/216
4,936,611 A * 6/1990 Palvolgyi ..... E05B 83/16 292/216
4,961,601 A * 10/1990 Lindholm ..... E05B 83/16 292/216
5,048,877 A * 9/1991 Rogers, Jr. ..... E05B 83/24 292/110
5,118,146 A * 6/1992 Watanuki ..... E05B 83/16 292/216
5,288,115 A * 2/1994 Inoue ..... E05B 81/20 292/201
5,348,355 A * 9/1994 Oyha ..... E05B 83/16 292/11
5,423,582 A * 6/1995 Kleefeldt ..... E05B 81/20 292/201
5,445,421 A * 8/1995 Ferrara ..... E05B 83/24 292/216
5,516,164 A * 5/1996 Kobayashi ..... E05B 81/20 292/201
5,618,069 A * 4/1997 Konchan ..... E05B 17/007 292/216
5,634,677 A * 6/1997 Buscher ..... E05B 81/06 292/216
5,738,393 A * 4/1998 Chao ..... E05B 83/24 292/216
5,802,894 A * 9/1998 Jahrsetz ..... E05B 77/48 292/144
5,853,060 A * 12/1998 Chao ..... E05B 83/16 180/69.2
5,868,444 A * 2/1999 Brackmann ..... E05B 81/20 292/196
5,938,251 A * 8/1999 Watanabe ..... E05B 81/20 292/201
5,997,055 A * 12/1999 Strathmann ..... E05B 81/06 292/199
6,012,747 A * 1/2000 Takamura ..... B60N 2/366 292/210
6,059,327 A * 5/2000 Yoshikuwa ..... E05B 83/16 292/216
6,076,868 A * 6/2000 Roger, Jr. ..... E05B 81/14 292/199
6,106,033 A * 8/2000 Ruckert ..... E05B 83/16 292/216
6,158,788 A * 12/2000 Ikeda ..... E05B 81/06 292/216
6,382,687 B1 * 5/2002 Gruhn ..... E05B 81/14 292/201
6,422,616 B1 * 7/2002 Wortmann ..... E05B 83/24 292/214
6,428,058 B1 * 8/2002 Graute ..... E05B 85/01 292/201
6,485,071 B2 * 11/2002 Schwaiger ..... E05B 83/16 292/216
6,575,507 B2 * 6/2003 Reddmann ..... E05B 81/14 292/201
6,581,987 B1 * 6/2003 Gentile ..... E05B 83/24 292/216
6,666,483 B2 * 12/2003 Baniak ..... E05B 83/24 292/123
7,111,878 B2 * 9/2006 Kachouh ..... E05B 81/14 292/201
7,210,714 B2 * 5/2007 Berghahn ..... E05B 81/20 292/201
7,261,337 B2 * 8/2007 Nakagome ..... E05B 83/24 292/216
7,434,852 B2 * 10/2008 Spurr ..... E05B 85/26 292/201
8,534,720 B2 * 9/2013 Meyer ..... E05B 83/16 292/216
8,573,658 B2 * 11/2013 Kim ..... B60R 21/34 292/201
8,646,816 B2 * 2/2014 Dziurdzia ..... E05B 17/0029 292/201
8,757,681 B2 * 6/2014 Graute ..... E05B 81/20 292/201
8,801,052 B2 * 8/2014 Bender ..... E05B 83/16 292/216
8,801,053 B2 * 8/2014 Alexander ..... E05B 47/0009 292/226
8,955,889 B2 * 2/2015 Bendel ..... E05B 81/20 292/200
9,027,971 B2 * 5/2015 Barczynski ..... E05B 83/24 292/100
9,187,936 B2 * 11/2015 Kim ..... E05B 83/24
9,534,428 B2 * 1/2017 Kim ..... E05B 83/24
2002/0017792 A1 * 2/2002 Raffelsiefer ..... E05B 77/245 292/216
2005/0218661 A1 * 10/2005 Brose ..... E05B 81/06 292/216
2006/0055180 A1 * 3/2006 Kachouh ..... E05B 77/36 292/216
2006/0055181 A1 * 3/2006 Berghahn ..... E05B 81/20 292/216
2006/0226661 A1 * 10/2006 Moore ..... E05B 81/20 292/216
2010/0052336 A1 * 3/2010 Bendel ..... E05B 85/26 292/196
2011/0127780 A1 * 6/2011 Barth ..... E05B 85/243 292/213
2011/0169280 A1 * 7/2011 Scholz ..... E05B 85/26 292/200
2012/0068479 A1 * 3/2012 Bendel ..... E05B 81/20 292/200
2012/0161456 A1 * 6/2012 Riedmayr ..... E05B 83/24 292/226
2012/0313384 A1 * 12/2012 Cumbo ..... E05B 81/14 292/199
2014/0049056 A1 * 2/2014 Scholz ..... E05B 81/14 292/200
2014/0062098 A1 * 3/2014 Kim ..... E05B 83/24 292/28
2014/0175813 A1 * 6/2014 Margheritti ..... E05B 77/34 292/201
2014/0203572 A1 * 7/2014 Barmscheidt ..... E05B 77/28 292/200
2014/0319848 A1 * 10/2014 Fannon ..... E05B 83/24 292/122
2015/0145263 A1 * 5/2015 Farris ..... E05B 83/24 292/195
2016/0076279 A1 * 3/2016 Ilea ..... E05B 83/24 292/220
2016/0214506 A1 * 7/2016 Mueller ..... B60N 2/01583
2018/0080266 A1 * 3/2018 Lebsak ..... E05B 85/26

* cited by examiner

DUAL UNLOCKING HOOD LATCH SYSTEM

CROSS-REFERENCE TO RELATED APPLICATION

This Application claims the benefit of priority to Korean Patent Application No. 10-2014-0066303 filed on May 30, 2014, which is incorporated by reference in its entirety.

TECHNICAL FIELD

The present disclosure relates to a dual unlocking hood latch that includes a dual unlocking function which enables a user to open an automobile hood from inside the automobile.

BACKGROUND

Generally, an automotive vehicle is equipped with a hood to protect the engine area and also to shield noise generated from the engine. The hood is hinged to the vehicle body and is movable. The hood is connected to a button or a lever inside the vehicle via wires and is configured such that the hood unlocks in response to the wire being pulled by the manipulation on the button or lever. The dual locking structure prevents the hood from accidentally opening due to moving air generated by passing vehicles, when the hood latch is not fully locked. This dual locking structure usually requires two steps to open the hood of an automotive vehicle: first, a user unlocks the hood latch and second, the user manually operates the safety hook.

According to the conventional method of releasing the striker from the hood latch, it is necessary for the driver to first manipulate the lever provided in front of the driver's seat in order to transmit the first releasing force, and thereafter, the driver has to get out of the vehicle to manually unlock the hood latch. This way of unlocking a hood latch inconveniences the user because he or she has to get out of the vehicle.

SUMMARY

The present disclosure is directed to a dual unlocking hood latch system. The system includes a base including a moving groove portion to guide the movement of a striker, a base fixed to a main body; a latch gear, pivotably attached the base to retain the striker entered through the moving groove portion, including a plurality of locking portions; a pawl, pivotably attached to the base, controlling the movement of the latch gear by transmitting rotational motion when in contact; and a stopper portion that is elastically biased to a direction of contact with the pawl when the stopper portion is pushed by the pawl to restrain pivoting movement of the latch gear.

In an embodiment, the latch gear may include a latch body attached to the base; a mounting groove portion, into which the striker is inserted; a first locking portion, protruding from the latch body positioned above the striker, which is inserted into the mounting groove portion; a second locking portion, separated from the first locking portion and protruding from a side of the latch body to be locked in the pawl at a locking position; and a third locking portion protruding from the latch body separated from the second locking portion locked in the pawl in a first unlocking position.

In an embodiment, the latch gear including the first locking portion, the mounting groove portion, the second locking portion, and the third locking portion is located along an outer side of the latch body.

In an embodiment, the pawl includes a pawl body pivotably positioned facing the latch gear, wherein the moving groove portion is located between the pawl and the latch gear; a locking protrusion, protruded from the pawl body, which is locked in one of the second locking portion; a third locking portion that restrains the latch body from pivoting; and a connecting protrusion, which extends on a lower side of the pawl body and is connected to an operating cable.

In an embodiment, the pawl body includes a locking groove portion, in which the stopper portion is inserted, formed on a side. In addition, a cover portion may be located between the pawl and the stopper, facing the base. The connecting protrusion is locked in the cover portion and restrains a clockwise rotation. The stopper portion may include a stopper body, positioned above the pawl and pivotably attached the base, and a stopper protrusion, which is extended from the stopper body and locked in a side of the pawl or pushed by the pawl to restrain the latch gear from moving upward. The stopper protrusion is pivoted in contact with the pawl, and temporarily retains the latch gear from pivoting during movement from a locking position at which the striker is locked to a first unlocking position. In an embodiment, the latch gear and the stopper portion are elastically supported clockwise, and the pawl is elastically supported counterclockwise.

In an embodiment, a latch gear moves apart from a pawl, contacts with a stopper portion and is restrained from pivoting. Thereafter, the latch gear moves to a first unlocking position, and the second pivoting of the pawl completely releases a striker. Therefore, a user may open the automobile hood while staying in the vehicle.

DETAILED DESCRIPTION

Figure 1:
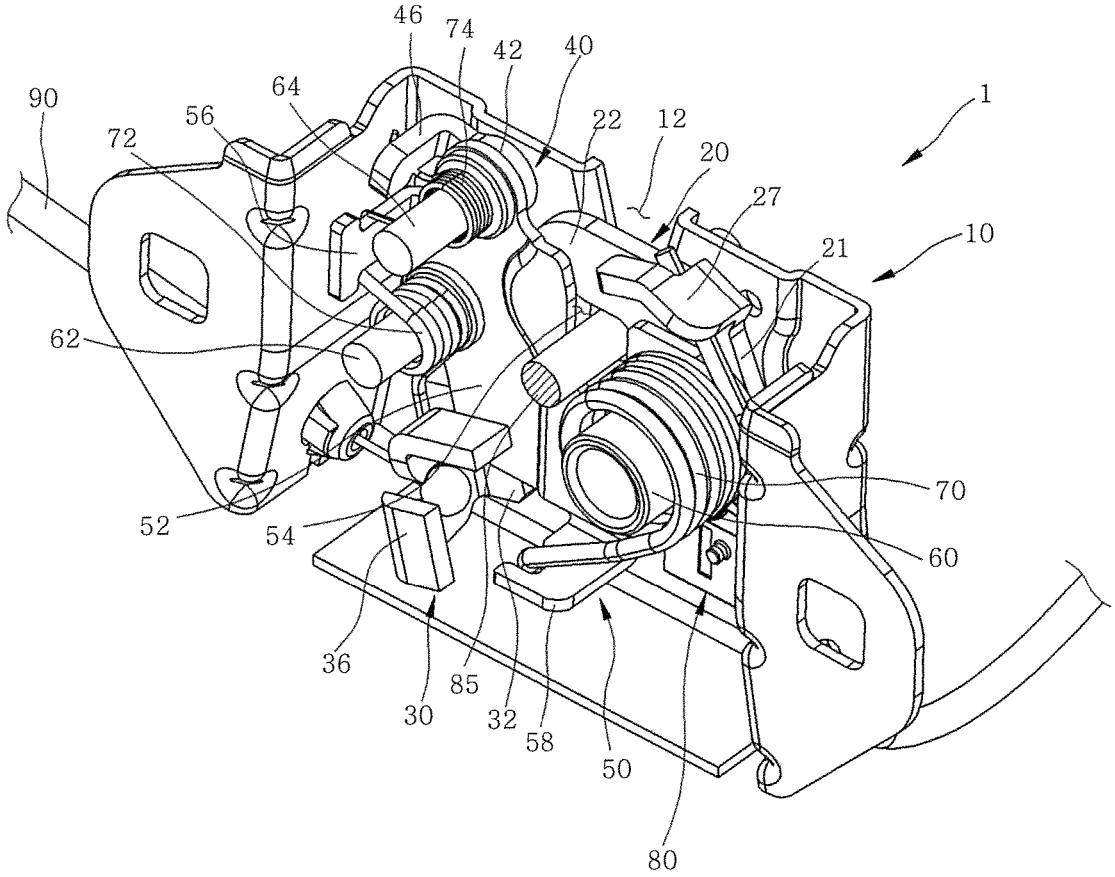
FIG. 1 is a view of a structure of a dual unlocking hood latch according to an embodiment.
Figure 2:
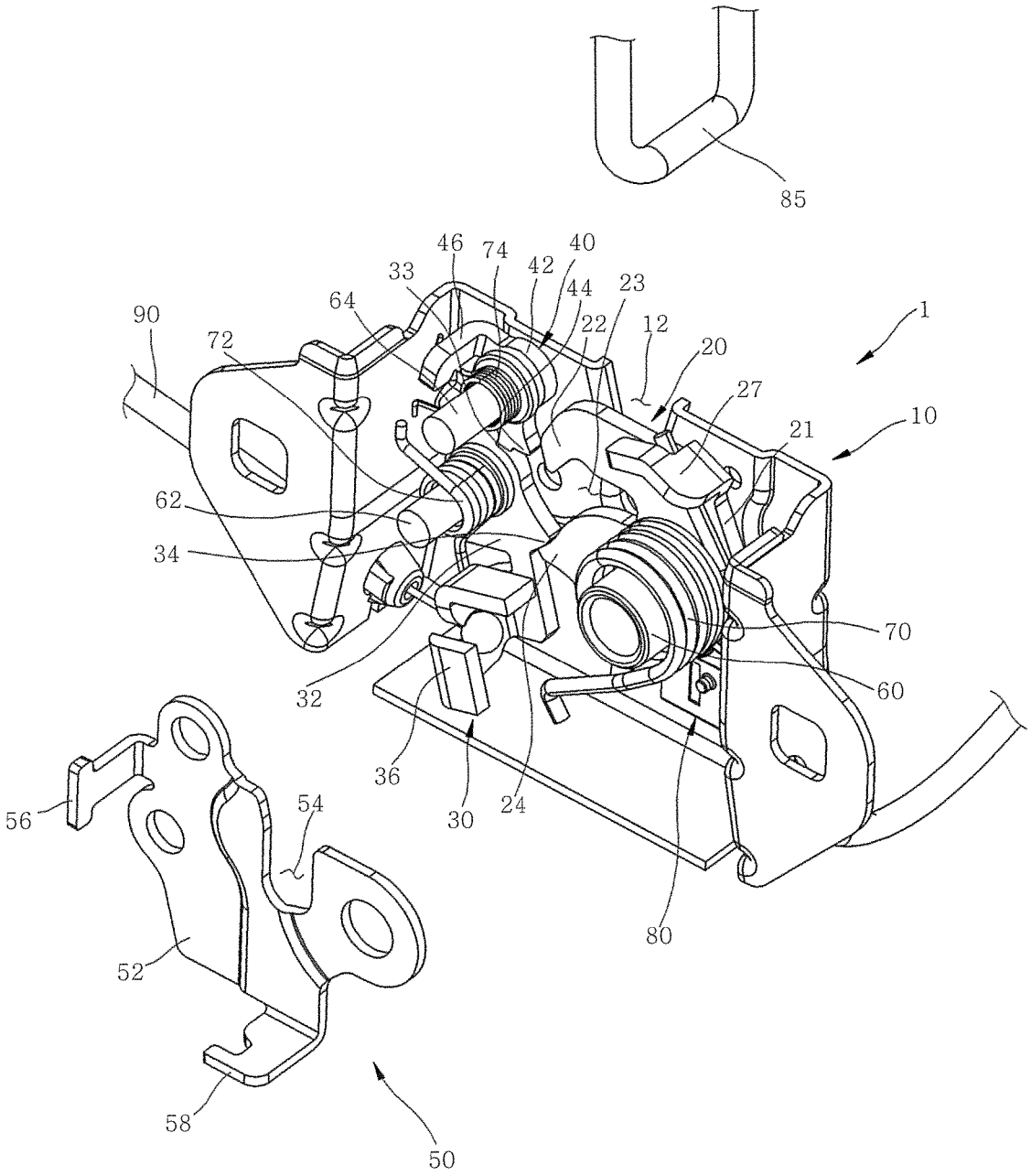
FIG. 2 is a perspective view of the dual unlocking hood latch with a cover portion removed according to an embodiment.

Reference will now be made in detail to various embodiments of the present disclosure. It should be understood that the scope of the present disclosure is not intended to be limited to those various referenced embodiments. On the contrary, the present disclosure is intended to cover not only the described embodiments, but also various alternatives, modifications, equivalents and other embodiments, which may be included within the spirit and scope of the disclosure as defined by the claims.

For convenience of explanation, in certain embodiments, the dual unlocking hood latch system is described as being installed on an automotive vehicle. Lines may be drawn in greater thickness or elements may be illustrated in enlarged sizes in exaggeration of ordinary scale thereof in the drawings, for the sake of clarity and convenience of explanation. Further, since the terminology used herein is defined in consideration of functions in the present disclosure, it can vary depending on the intention or practice of a user or operator. For example, throughout the present disclosure, the phrase "attached to" is used to broadly describe various embodiments. It is noted that "attached to" may also mean "joined to" "fastened to", "fixed to", "connected to", "linked to", "secured to", "appended to", "coupled to", "bound to", "hitched to", "riveted to", or other equivalents thereof. Moreover, throughout the present disclosure, the word "pivot" and "pivotably" are used to broadly describe various embodiments. It should be noted that "pivot" may also mean "rotate", "revolve", "spin", "move", "hinge", "turn", or other equivalents thereof. Therefore, definitions of the terms or wordings should be made based on the content throughout the description.

FIG. 1 is a view of a dual unlocking hood latch system 1 according to an embodiment. In this embodiment the dual unlocking latch system includes a base 10, a latch gear 20, a pawl 30, a stopper portion 40, a cover portion 50, and a switch portion 80. The base 10 is attached to a main body of a vehicle in an embodiment and includes a moving groove 12, which allows a striker 85 (in FIG. 3) to move upward and downward therein. The base 10 may be in various forms. In an embodiment, the base 10 is formed into a plate configuration and includes the moving groove 12 in a longitudinal direction to guide the movement of the striker 85. One end of the moving groove 12 is open and the other end is closed. Although certain embodiments of the present disclosure are described as being implemented in a vehicle, the scope of the disclosure is not limited thereto. For example, embodiments of the dual unlocking hood latch system may be implemented in other locking mechanisms for doors, cabinets, drawers, hatches, and such.

Figure 3:
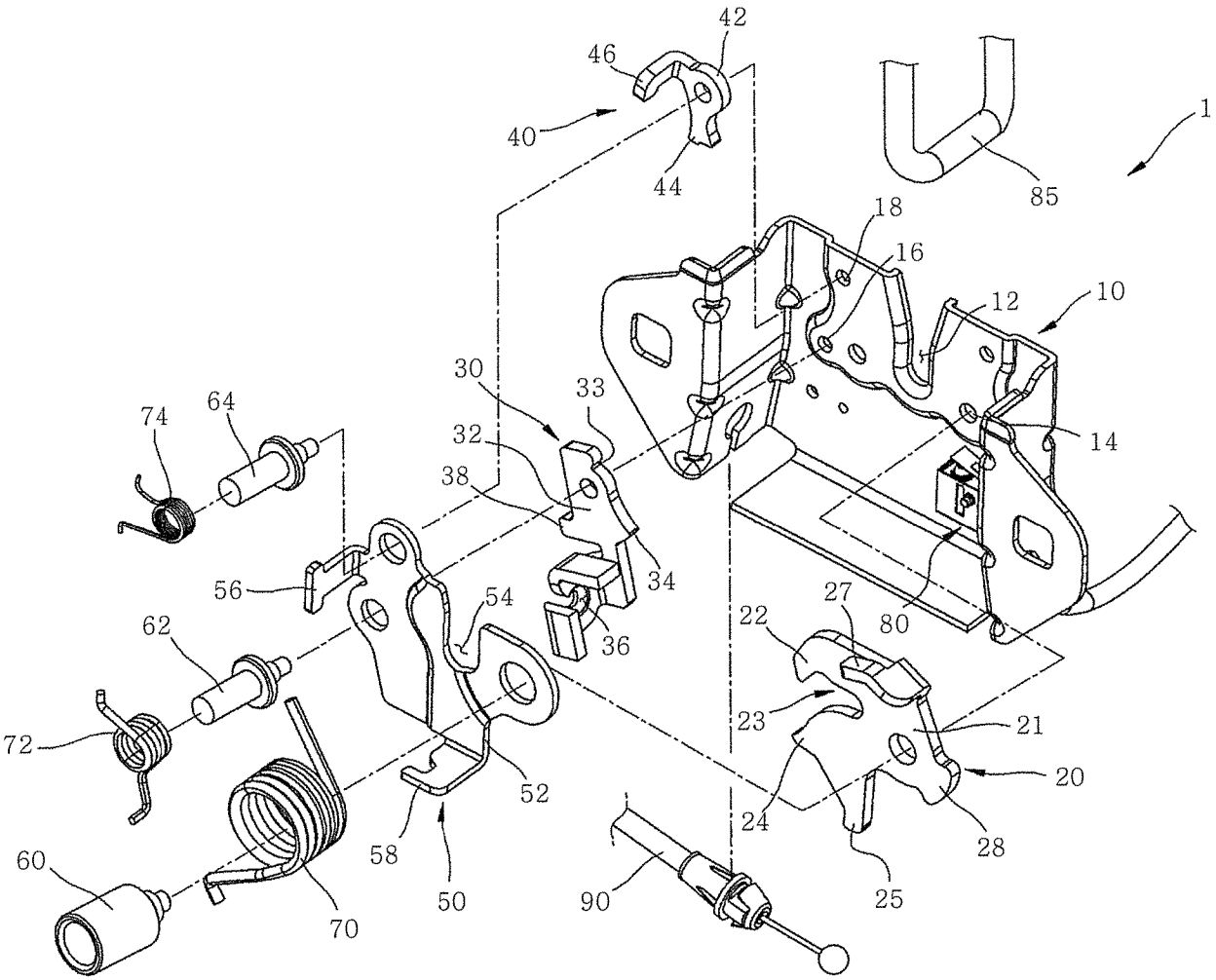
FIG. 3 is an exploded perspective view of the dual unlocking hood latch according to an embodiment.

FIG. 3 is an exploded perspective view of the dual unlocking hood latch according to an embodiment. The latch gear 20 is pivotably attached offset to the right of the moving groove 12 on the front-facing side of the base 10, and the pawl 30 is pivotably attached offset to the left of the moving groove 12 on the front-facing side of the base 10. A first support shaft 60 is inserted into a first engagement hole 14 of the base 10 through a first hole of the cover body 52 of the cover portion 50 and a latch body 21 of the latch gear 20, and a second support shaft 62 is inserted into a second engagement hole 16 of the base 10 through a second hole of the cover body 52 of the cover portion 50 and a pawl body 32 of the pawl 30. A third support shaft 64 is inserted into a third engagement hole 18 through a third hole of the cover portion 50 and a stopper body 42 of the stopper portion 40. The broken lines represent the alignment of the various parts through which the first support shaft 60, the second support shaft 62, and the third support shaft 64 are inserted through the respective first engagement hold 14, second engagement hole 16, and third engagement hole 18 of the base 10.

According to an embodiment, the latch gear 20 is pivotably attached to the base 10 and restrains the striker 85, which is attached to a hood or door and entered through the moving groove 12. The latch gear 20 includes a plurality of locking portions in an embodiment, and may be in various forms. As illustrated in FIG. 3, in an embodiment, the latch gear 20 includes a latch body 21, a first locking portion 22, a mounting groove portion 23, a second locking portion 24, a third locking portion 25, a latch extension piece 27 and a detection protrusion 28. The mounting groove portion 23 receives the striker 85 when inserted into the moving groove 12.

The first locking portion 22 may be in various forms. In an embodiment, the first locking portion 22 protrudes from the latch body 21 and is placed above the striker 85 when the striker 85 is inserted into the mounting groove portion 23. In an embodiment, in the locking position, the first locking portion 22 extends to the direction of the pawl 30 and retains the striker 85, which is in the moving groove 12, from moving upward and out of the moving groove 12.

In an embodiment, the mounting groove portion 23, which is between the first locking portion 22 and the second locking portion 24, includes a groove formed therein to receive the striker 85 which moves upward and downward through the moving groove 12 of the base 10.

The second locking portion 24 may be in various forms. In an embodiment, in its locking position—at which the striker 85 is in a completely locked state in the hood latch (1)—the second locking portion 24 is locked with the pawl 30, thus retaining the latch gear 20 from pivoting.

In an embodiment, the mounting groove 23 is located between the second locking portion 24 and the first locking portion 22. The second locking portion 24 is extended laterally from the latch body 21 when locked into the pawl 30's locking portion. The second locking portion 24, which is positioned under the striker 85 when the striker 85 is in the moving groove portion 12 while in the locking position, may be pushed by the striker 85 to pivot downward, and may push the striker 85 and pivot upward. That is, based on the location of the pawl 30, the second locking portion 24 may pivot together with the latch body 21 and contact the pawl 30 to restrain the latch gear 20 from pivoting or may not contact the pawl 30 but pass the pawl 30 to pivot clockwise or counterclockwise, depending on the position of the pawl 30.

The third locking portion 25 may also be in various forms. The third locking portion 25 is protruded from the latch body 21. In an embodiment, the third locking portion 25 is locked into the pawl 30 in a first unlocking position. The first unlocking position is the position between the locking position and the completely unlocked position. When the second locking portion 24 extends toward the pawl 30, the third locking portion 25 extends in the downward direction. In one an embodiment, the second locking portion 24 is locked into the locking protrusion 34 of the pawl 30 in the locking position, and the third locking portion 25 is locked into the locking protrusion 34 of the pawl 30 in the first unlocking position, thus retaining the latch gear 20 from pivoting.

The latch extension piece 27 may be in various shapes and forms. In an embodiment, the latch extension piece 27 is protruded from the latch body 21 and supports a first elastic member 70.

In an embodiment, the latch gear 20 includes the first locking portion 22, the second locking portion 24, and the third locking portion 25, which protrude from outer sides of the latch body 21 around a pivotal axis of the latch body 21, and the mounting groove 23. The pawl 30 may be in various forms. In an embodiment, the pawl 30 is pivotably attached to the base 10 and restrains the latch gear 20 from pivoting. In an embodiment, the pawl 30 includes a pawl body 32, a locking groove portion 33, a locking protrusion 34, a connecting protrusion 36 and a side protrusion 38.

The pawl body 32 is pivotably attached to the base 10 opposite from the latch gear 20, relative to the moving groove portion 12 in between. One side of the second support shaft 62 is attached to the base 10 through the cover body 52 of the cover portion 50, pawl body 32 of pawl 30, and the second connecting hole 16 of the base 10. The second elastic member 72 is placed around the other extended side of the second support shaft 62 and elastically supports the pawl 30. When the dual unlocking hood latch system 1 is in the locking position, the second support shaft 62 is passed through the upper side of the pawl body 32, and the pawl body 32 extends downward from the second support shaft 62.

In an embodiment, the stopper portion 40 is inserted and secured to the locking groove portion 33. The locking groove portion 33 is formed in a concave shape on the side of the pawl body 32 that faces the stopper protrusion 44 of the stopper portion 40 thereof. According to an embodiment, when the dual unlocking hood latch system 1 is in the locking position, the stopper protrusion 44 is inserted into the locking groove portion 33 and restrains the stopper portion 40 from further movement.

In an embodiment, the locking protrusion 34 protrudes from the pawl body 32 toward the moving groove portion 12 of the base 10. The latch gear 20 is retained from pivoting when the second locking portion 24 is locked into the locking protrusion in the locking position, or when the third locking portion 25 is locked into the locking protrusion 34 in the first unlocking position. The locking protrusion 34 may be formed in different shapes and may include various methods of restraining the latch gear 20 from moving, according to various embodiments of the present disclosure. The locking protrusion 34 extends toward the latch gear 20 and may be pivotally pushed in the clockwise direction by the second locking portion 24 or the third locking portion 25 when the latch gear 20 moves pivotally in the counter-clockwise direction, or may restrain the second locking portion 24 and the third locking portion 25 from moving pivotally in a clockwise direction.

The connecting protrusion 36 may be formed in different forms and shapes, according to various embodiments of the present disclosure. In an embodiment, the connecting protrusion 36 extends orthogonally outward in a direction parallel to the second support shaft 62 on a lower side of the pawl body 32 and connects to the operating cable 90. When the operating cable 90 is inserted and/or secured to the connecting protrusion 36, the pawl 30 and the connecting protrusion 36 move in response to the movement of the operating cable 90.

In an embodiment, the side protrusion 38 extends laterally from the pawl body 32 to the other side (left-hand side in an embodiment illustrated in FIG. 3), away from the latch gear 20, and is in contact with the base 10, when the pawl 30 pivots clockwise (see, e.g., FIGS. 8 and 10), thus restraining the pawl 30 from moving beyond a certain angle.

The stopper portion 40 is pivotably attached to the base 10, and may be in various forms and shapes according to various embodiments of the present disclosure. The stopper portion 40 is elastically pressured to a direction of a contacting pawl 30 and is pushed by the pawl 30, and thus temporarily restrains the latch gear 20 from pivoting counter-clockwise. In an embodiment, the stopper portion 40 includes the stopper body 42, the stopper protrusion 44 and the supporting piece 46. The stopper portion 40 is pivotably attached to the base 10 above the pawl 30.

The stopper protrusion 44 extends from the stopper body 42. The stopper protrusion 44 may be in various forms according to various embodiments of the present disclosure. In an embodiment, the stopper protrusion 44, positioned at a lower side of the stopper body 42, extends downward from the hole of the stopper body 42 through which the third support shaft 64 is pivotably attached to the base 10. On the lower side of the stopper protrusion 44, a jagged groove is formed to facilitate locking of the second locking portion 24 (see, e.g., FIG. 7) or the third locking portion 25 (see, e.g. FIG. 11) of the latch gear 20 therein.

The supporting piece 46 protrudes orthogonally from the stopper body 42 and supports the third elastic member 74. In the absence of external force, the supporting piece 46 and the stopper portion 40 are elastically supported clockwise by the third elastic member 74. In the absence of external force, the latch gear 20 is elastically supported clockwise and the pawl 30 is elastically supported counterclockwise. Accordingly, the stopper protrusion 44 rotates while in contact with the pawl 30.

In an embodiment, the stopper protrusion 44 of the stopper portion 40 may temporarily restrain the latch gear 20 from pivoting, when the latch gear 20 moves from the locking position, at which the striker 85 is restrained, to the first unlocking position.

The cover portion 50 may be in different shapes and forms according to various embodiments of the present disclosure. In an embodiment, the cover portion 50 is positioned facing the base 10, and the latch gear 20 and the pawl 30 are between the cover portion 50 and the base 10. In an embodiment, as illustrated in FIG. 3, the cover portion 50 includes a cover body 52, a guide groove portion 54, a cover protrusion 56 and a supporting piece 58. The cover body 52 is attached to the base 10 and includes the guide groove portion 54 at a position corresponding to the moving groove portion 12 of the base 10.

In an embodiment, the cover protrusion 56 and the supporting piece 58 protrudes orthogonally from the cover body 52 away from the base 10. The supporting piece 58 is on a lower side of the cover body 52, and the cover protrusion 56 is on a side (left-hand side in FIG. 3) of the cover body 52 that is facing away from the moving groove portion 12.

In an embodiment, one side of the second elastic member 72 is supported by the bottom of cover protrusion 56, and the other side of the second elastic member 72 is supported by the side protrusion 38 of the pawl 30. The second elastic member 72 elastically supports the pawl 30 counterclockwise. One side of the first elastic member 70 is supported on the supporting piece 58, and the other side of the first elastic member 70 is supported on a latch extension piece 27 of the latch gear 20. The first elastic member 70 elastically supports the latch gear 20 clockwise.

Because the clockwise pivoting of the connecting protrusion 36 of the pawl 30 is locked by the cover portion 50, the pawl 30 is restrained from pivoting beyond a certain angle.

In an embodiment, the first elastic member 70, in a coil shape, is pivotably placed around the first support shaft 60, as shown, e.g., in FIG. 1. The second elastic member 72, in a coil shape, is pivotably placed around the outer side of the second support shaft 62, as shown, e.g., in FIG. 1.

The third elastic member 74, in a coil shape, is pivotably placed around the outer side of the third support shaft 64, as shown, e.g., in FIG. 1.

In an embodiment, the second elastic member 72 may be omitted. That is, when the stopper portion 40, which is elastically supported clockwise by the third elastic member 74, continuously contacts with the pawl 30 and forces the pawl 30 to pivot clockwise, the second elastic member 72 may be omitted. Other modifications are applicable. For example, in an embodiment, an integrated elastic member combining the functionalities of the second elastic member 72 and the third elastic member 74 may be used.

Figure 4:
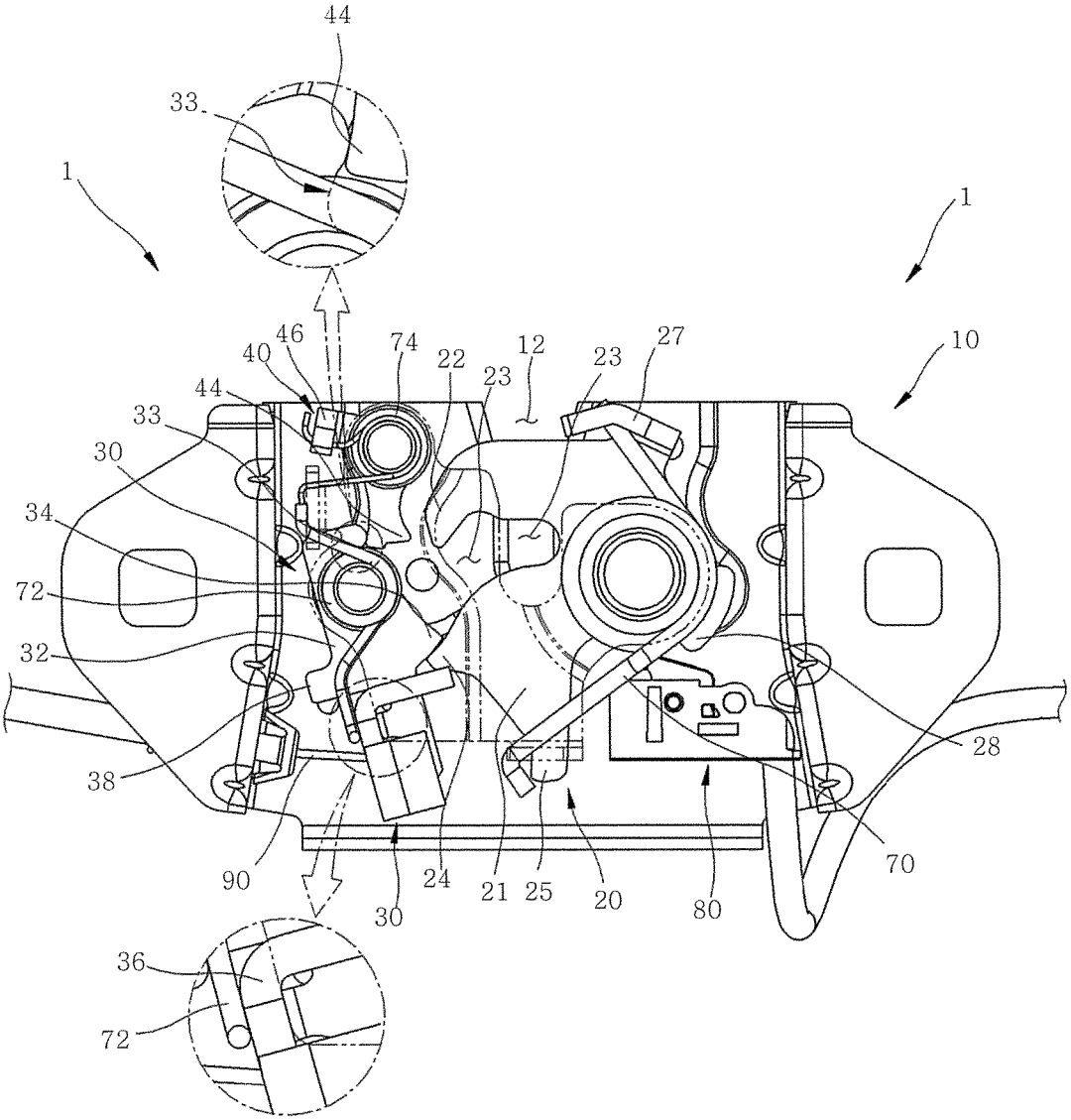
FIG. 4 is a front view of the dual unlocking hood latch without the cover portion according to an embodiment.

The switch portion 80 is attached to the base 10, under the hole of the latch gear 20 through which the first support shaft 60 is pivotably attached to the base 10. The switch portion 80 operates in response to the movement of the latch gear 20 to indicate the pivoting position of the latch gear 20 to a controller which may be communicatively coupled to a display panel or some other means to indicate a state of the dual unlocking hood latch system 1. In an embodiment, the controller may be a controller for a dashboard control panel, processor or computer. In an embodiment, the switch portion 80 may employ a touch-sensitive switch. According to an embodiment, the detection protrusion 28 presses on the switch portion 80 due to pivoting of the latch gear 20 (see, e.g. FIG. 11). In an embodiment, the detection protrusion 28 does not press down onto the switch portion 80 when the latch gear 20 is in the locking position (see, e.g. FIG. 4), and presses down onto the switch portion when the latch gear 20 rotates to the first unlocking position (see, e.g. FIG. 9).

In an embodiment, the latch gear 20 and the stopper portion 40 are elastically supported clockwise, and the pawl 30 is elastically supported counterclockwise, but the present disclosure is not limited thereto. Accordingly, various modifications may be applicable. For example, in an embodiment, a user may switch the directions to which the respective members are elastically supported. That is, the latch gear 20 and the stopper portion 40 may be elastically supported counterclockwise, while the pawl 30 is elastically supported clockwise, or all of the latch gear 20, the stopper portion 40 and the pawl 30 may be elastically supported clockwise or counterclockwise.

Figure 5:
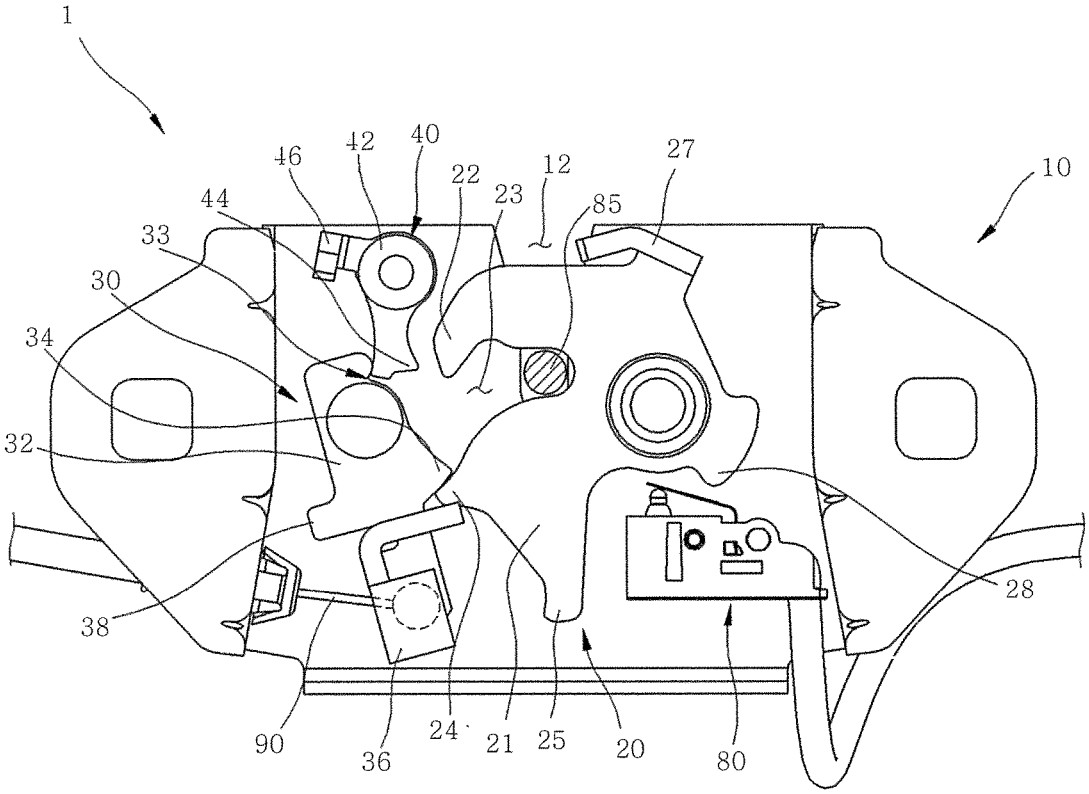
FIG. 5 is a front view of a latch gear of the dual unlocking hood latch placed in a locking position according to an embodiment.

Referring to FIG. 5, when in the locking position, the striker 85 is located between the first locking portion 22 and the second locking portion 24 (i.e. inside the mounting groove portion 23), and the latch gear 20 is restrained from pivoting. In such position, the second locking portion 24 of the latch gear is locked in the locking protrusion 34 of the pawl 30. Although the latch gear 20 is urged to pivot clockwise due to the clockwise elastic recovery force, the latch gear 20 is restrained from pivoting when the latch gear 20 is locked by the pawl 30, which is elastically supported counterclockwise. When the latch gear 20 is in the locking position, the striker 85, which is inserted in the mounting groove portion 23, is restrained from moving upward. The stopper protrusion 44 of the stopper portion 40 is also locked in the locking groove portion 33 of the pawl 30 and is restrained from pivoting.

Figure 8:
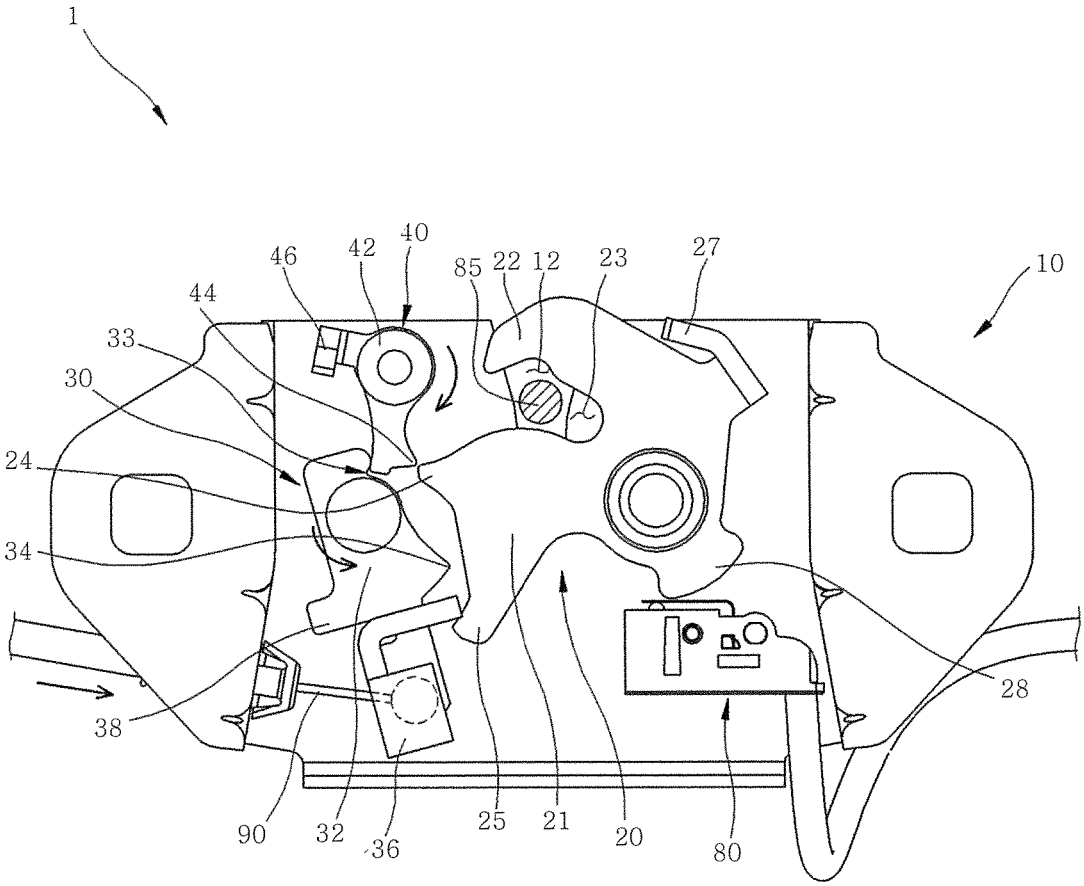
FIG. 8 is a front view of a stopper portion and a latch gear moving away from each other, when the operating force of an operating cable is released according to an embodiment.
Figure 9:
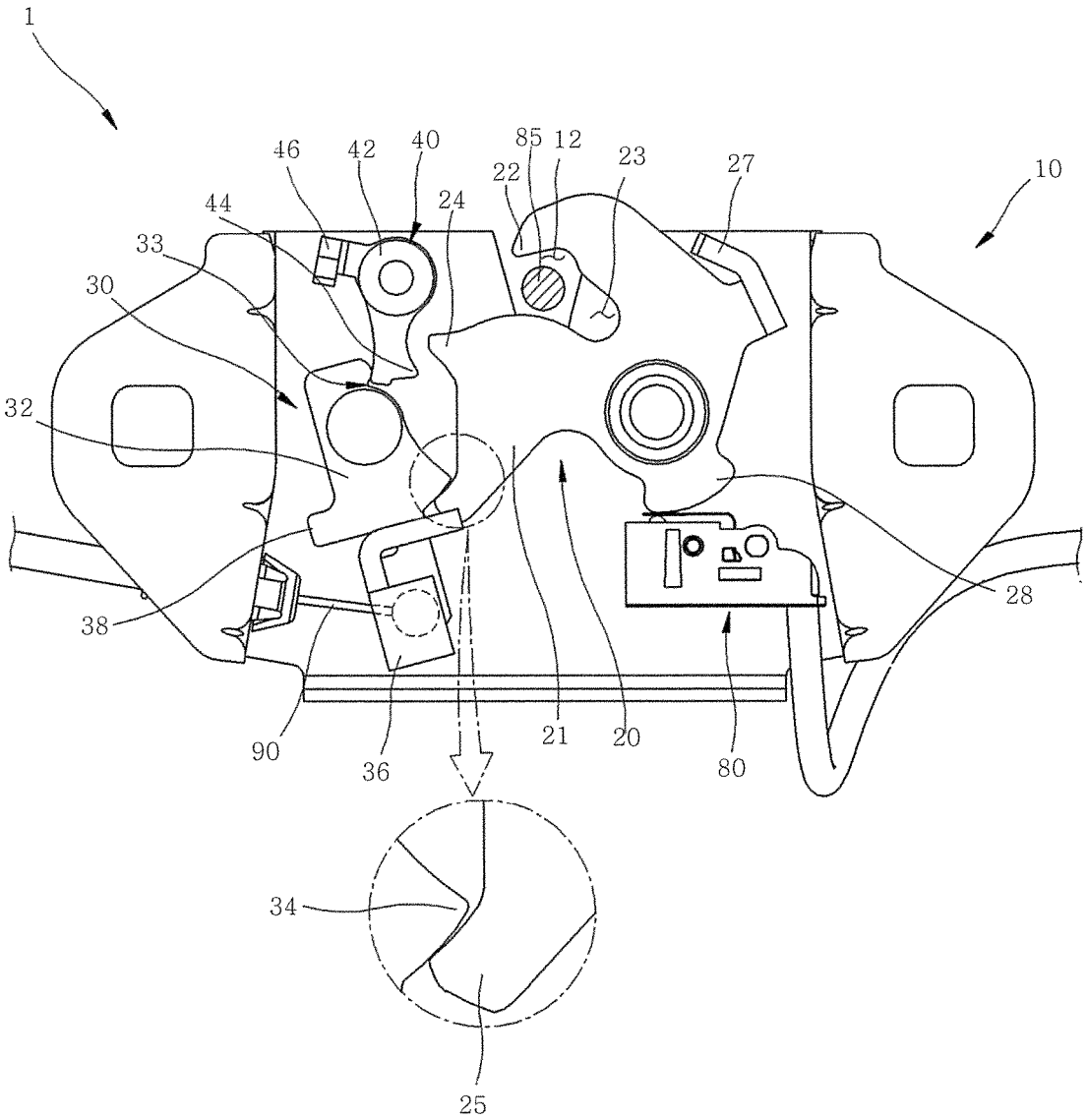
FIG. 9 is a front view of a latch gear in a first unlocking position according to an embodiment.
Figure 10:
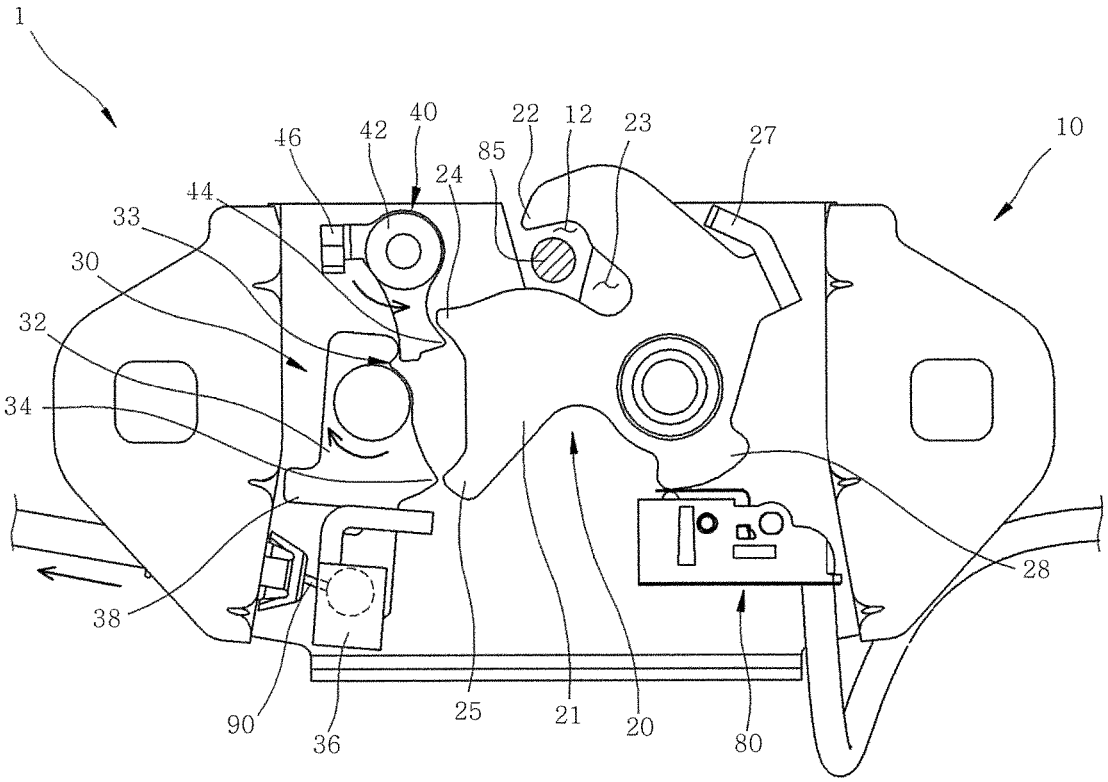
FIG. 10 is a front view of a pawl being pulled by an operating cable for the second time according to an embodiment.
Figure 11:
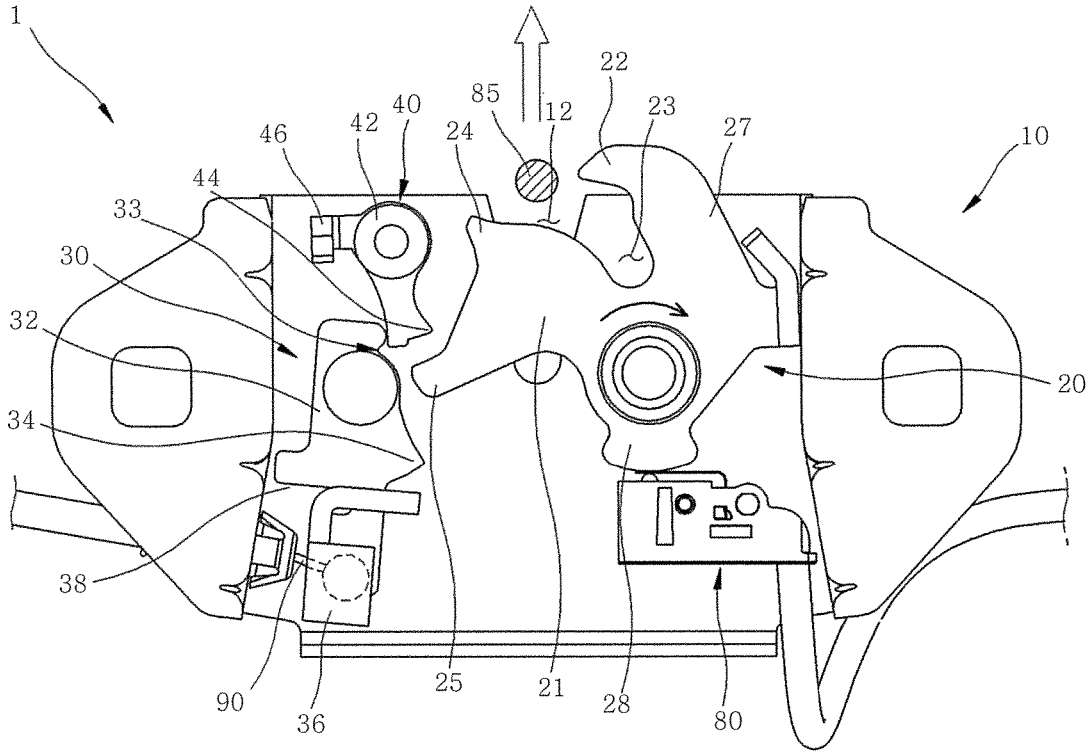
FIG. 11 is a front view of a striker being released when a latch gear rotates clockwise from the first unlocking position according to an embodiment.

FIGS. 6-11 illustrate the dual unlocking process according some embodiments of the present disclosure. FIG. 5 illustrates a locking position according to an embodiment of the present disclosure. FIGS. 6-9 illustrate a progression from the locking position to the first unlocking position according to some embodiments of the present disclosure. FIGS. 10-11 illustrate a progression from the first unlocking position to the completely unlocked position according to some embodiments of the present disclosure.

Figure 6:
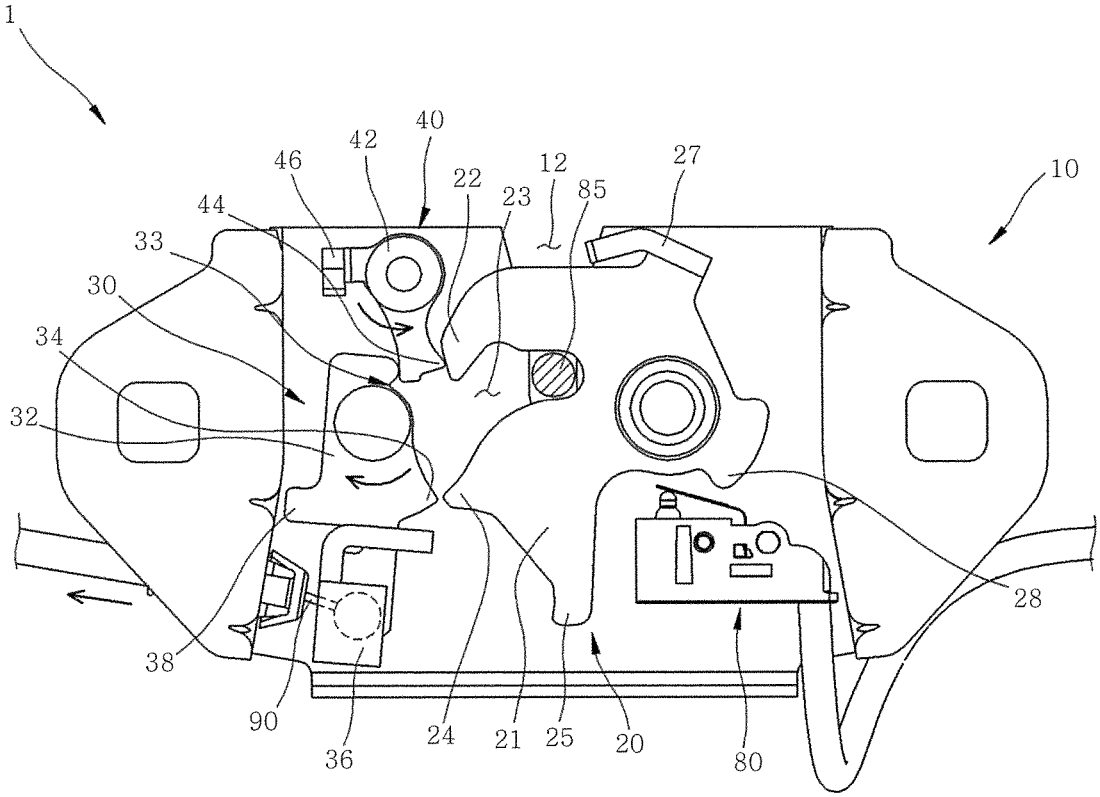
FIG. 6 is a front view of a pawl being pulled by an operating cable for the first time according to an embodiment.

Referring to FIG. 6, as the operating cable 90 is pulled leftward in response to a driver's first manipulation of the dual unlocking hood latch system 1, the connecting protrusion 36 of the pawl 30 connected to the operating cable 90 are pivoted clockwise. The locking protrusion 34 of the pawl 30 moves away from the second locking portion 24 of the latch gear 20, and the locking groove portion 33 of the pawl body 32 is pivoted clockwise to push a side of the stopper protrusion 44. Accordingly, the stopper portion 40 is pivoted counterclockwise.

Figure 7:
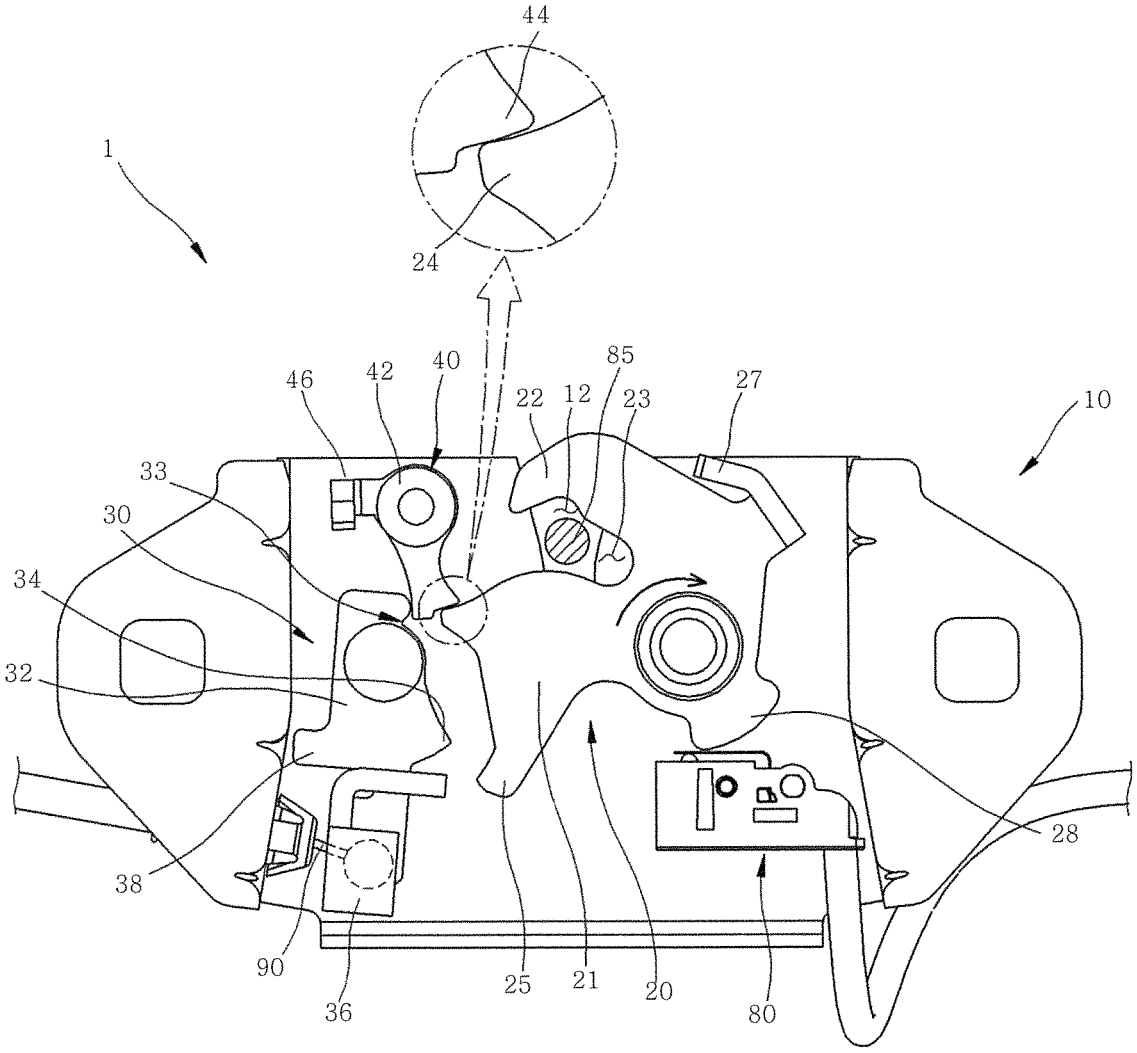
FIG. 7 is a front view of a stopper portion pivoted to retrain a latch gear from rotating according to an embodiment.

Referring to FIG. 7, while in the locking position, the stopper protrusion 44 of the stopper portion 40 is pushed by the latch gear 20 and positioned to block movement of the second locking portion 24. In such a state, clockwise pivotal force of the latch gear 20 causes the second locking portion 24 of the latch gear 20 to be in contact with the stopper protrusion 44, thereby restraining the latch gear 20 from pivoting.

If the stopper portion 40 does not exist to restrain the latch gear 20 from pivoting, the third locking portion 25 of the latch gear 20 would not be locked in the locking protrusion 34 of the pawl 30, but rather would continually pivot and unlock the striker 85. Accordingly, the striker 85 may accidentally be unlocked by one operation of the operating cable 90. In an embodiment, the latch gear 20 does not pivot directly from the locking position to the completely unlocked position, but rather moves to the first unlocking position at which the latch gear 20 is temporarily locked in the stopper portion 40, and the third locking portion 25 is locked in the locking protrusion 34 of the pawl 30.

Referring to FIG. 8, when the pulling force of the operating cable 90 is ceased, the pawl 30 pivots counterclockwise due to the elastic recovery force of the spring of the second elastic member 72, and the stopper portion 40 pivots clockwise due to the elastic recovery force of the third elastic member 74. Accordingly, the locking protrusion 34 moves along the moving route of the third locking portion 25. The stopper protrusion 44 moves away from the second locking portion 24, and the latch gear 20 may pivot clockwise.

Referring to FIG. 9, striker 85 is in the first unlocking position due to the additional clockwise pivoting of the latch gear 20, which causes the third locking portion 25 locked in the locking protrusion 34

Referring to FIG. 10, as the driver in the vehicle performs the second manipulation, the operating cable 90 is pulled, the pawl 30 pivots clockwise, and the locking protrusion 34 of the pawl 30 moves away from the third locking portion 25 of the latch gear 20.

Referring to FIG. 11, the latch gear 20 pivots clockwise due to the elastic recovery force of the first elastic member 70, thereby moving the third locking portion 25 away from the locking protrusion 34. In response to the pivoting of the latch gear 20, the striker 85 moves from the mounting groove portion 23, to above the latch gear 20 and out of the moving groove 12. Therefore, the dual unlocking hood latch system 1 is in the completely unlocked position, and the striker 85 is unlocked.

This allows a user to open the automobile hood while staying in the vehicle.

The present disclosure has been explained and illustrated with reference to the drawings and embodiments for illustrative example, but not limited thereto. Accordingly, those with ordinary skill in the art will be able to understand that a variety of modifications and equivalents are implementable. Further, while the exemplary hood latch with a dual unlocking function for use in the automotive vehicle has been explained for illustrative example, the disclosure is not limited thereto. Accordingly, the hood latch with a dual unlocking function according to embodiments of the present disclosure can be adapted for use in other mechanical devices.

What is claimed is:

1. A dual unlocking hood latch system, comprising:

a base comprising a moving groove portion for guiding a movement of a striker, the base attached to a main body;

a latch gear comprising a first locking portion, a second locking portion and a third locking portion, the latch gear pivotably attached to a front side of the base for directly restraining the striker in a mounting groove portion between the first locking portion and the second locking portion when the striker is entered through the moving groove portion to a locking position and for directly restraining the striker from further unlocking when the dual unlocking hood latch system transitions from the locking position to a first unlocking position, the latch gear comprising a plurality of locking portions;

a pawl pivotably attached to the base, the pawl comprising a single locking protrusion for directly restraining the latch gear from rotating by directly abutting against the second locking portion of the latch gear when the dual unlocking hood latch system is in the locking position and by abutting against the third locking portion of the latch gear the first unlocking position; and a stopper portion comprising a stopper protrusion and pivotably attached to the base and elastically pressured to a direction of the pawl such that the stopper portion is in constant direct contact with the pawl during both the locking position and the first unlocking position, wherein the stopper portion is pushed by the pawl to restrain the movement of the latch gear such that the pawl abuts the stopper portion when the dual unlocking hood latch system transitions from the locking position to the first unlocking position, and while the dual unlocking hood latch system transitions from the locking position to the first unlocking position, the stopper is pushed by the pawl to temporarily restrain the latch gear from rotating by causing the stopper protrusion to directly abut against the a second locking portion of the latch gear.

2. The dual unlocking hood latch system of claim 1, wherein the latch gear further comprises:

a latch body pivotably attached to the base and comprising the plurality of locking portions and the mounting groove portion, wherein the striker is inserted into the mounting groove portion when the striker is entered through the moving groove portion to the locking position, wherein:

the first locking portion protrudes from a first side of the latch body;

the second locking portion protrudes from a second side of the latch body and is restrained by the pawl while in the locking position, the mounting groove portion formed between the first locking portion and the second locking protrusion; and the third locking portion protrudes from the latch body to be restrained by the pawl in the first unlocking position, wherein the latch body is configured to restrain the striker in the mounting groove portion when the dual unlocking hood latch system is in the locking position, and the first locking portion is configured to restrain the striker when the dual unlocking hood latch system is in the first unlocking position.

3. The dual unlocking hood latch system of claim 2, wherein the latch gear comprises, in turn, the first locking portion, the mounting groove portion, the second locking portion, and the third locking portion about a pivotal axis of the latch body and protruding outward of the latch body.

4. The dual unlocking hood latch system of claim 2, wherein the pawl comprises:

a pawl body pivotably formed at a location offset from the moving groove portion and opposing the latch gear;

the single locking protrusion protruded from the pawl body to restrain the second locking portion during the locking position and to restrain the third locking portion during the first unlocking position to restrain the latch gear from pivoting; and a connecting protrusion extended in a direction orthogonal to the base on a lower side of the pawl body and configured to couple the pawl to an operating cable.

5. The dual unlocking hood latch system of claim 4, wherein the pawl body comprises a locking groove portion formed in a side of the pawl body and configured to restrain the stopper portion.

6. The dual unlocking hood latch system of claim 4, further comprising a cover portion formed such that the cover portion opposes the base, with the latch gear, the pawl and the stopper portion in between, and the connecting protrusion is locked in the cover portion and restrained from pivoting.

7. The dual unlocking hood latch system of claim 1, wherein the stopper portion comprises:

a stopper body placed above the pawl and pivotably formed on the base; and the stopper protrusion extending from the stopper body and configured to be engaged with a locking groove portion of the pawl during the locking position and pushed by the pawl to temporarily restrain the third locking portion of the latch gear from pivoting while transitioning from the locking position to the first unlocking position.

8. The dual unlocking hood latch system of claim 1, wherein the latch gear and the stopper portion are elastically supported in a first rotational direction, and the pawl is elastically supported in second rotational direction that is opposite to the first rotational direction.

* * * * *